United States Patent [19]

Lunbeck

[11] Patent Number: 4,759,305

[45] Date of Patent: Jul. 26, 1988

[54] FOIL CONTROL FEEDBACK MECHANISM

[76] Inventor: Lawrence E. Lunbeck, 4987 Lamont St., San Diego, Calif. 92109

[21] Appl. No.: 32,934

[22] Filed: Apr. 1, 1987

Related U.S. Application Data

[63] Continuation of Ser. No. 718,170, Apr. 1, 1985, abandoned, which is a continuation of Ser. No. 432,349, Jul. 8, 1983, abandoned.

[51] Int. Cl.[4] ..... B63H 9/04; B63H 9/10

[52] U.S. Cl. ..... 114/39.1; 114/102

[58] Field of Search ..... 114/39.1, 39.2, 102, 114/103, 144 C, 144 R, 270; 416/196 A, 170 A, 9–16; 244/82; 180/2.2

[56] References Cited

U.S. PATENT DOCUMENTS

| | | | |
|---|---|---|---|
| 1,802,226 | 4/1931 | Torkelson | 244/82 |
| 2,893,339 | 7/1959 | Ram | 114/39.1 |
| 4,236,409 | 12/1980 | Brachet | 114/102 X |

FOREIGN PATENT DOCUMENTS

| | | | |
|---|---|---|---|
| 144655 | 3/1954 | Sweden | 114/39.1 |

*Primary Examiner*—Sherman D. Basinger
*Assistant Examiner*—Edwin L. Swinehart
*Attorney, Agent, or Firm*—Blakely, Sokoloff, Taylor & Zafman

[57] ABSTRACT

A device for controlling the angle of a foil or sail in relation to a force acting upon it. The device utilizes a 2:1 hypocycloidal gearing system which regulates the boom and sail of a boat. The device functions automatically, eliminating the need for human intervention when the relative wind direction changes.

17 Claims, 3 Drawing Sheets

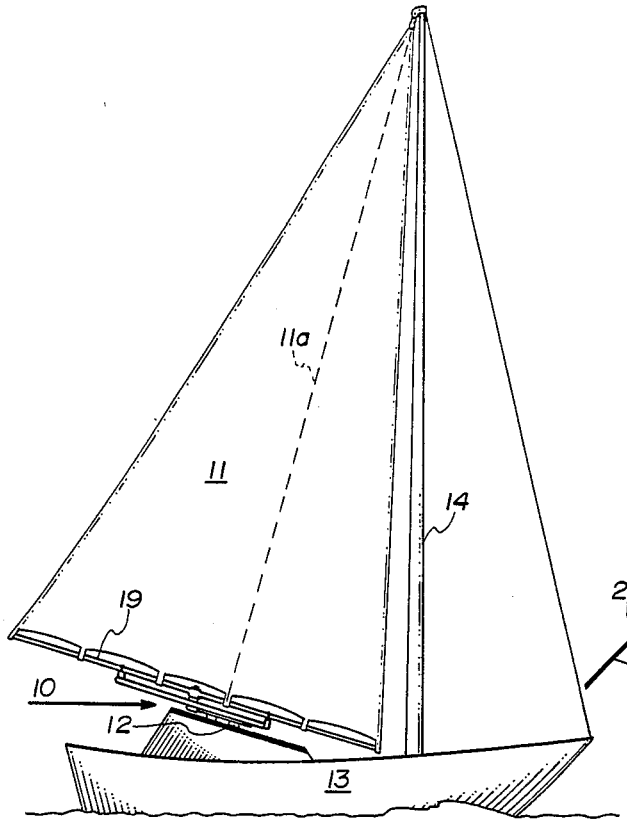
Fig. 1A
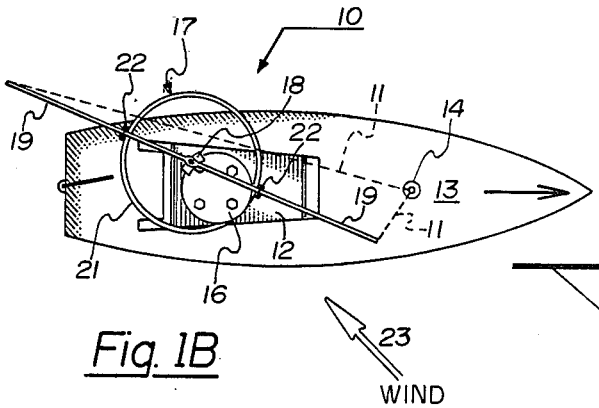
Fig. 1B
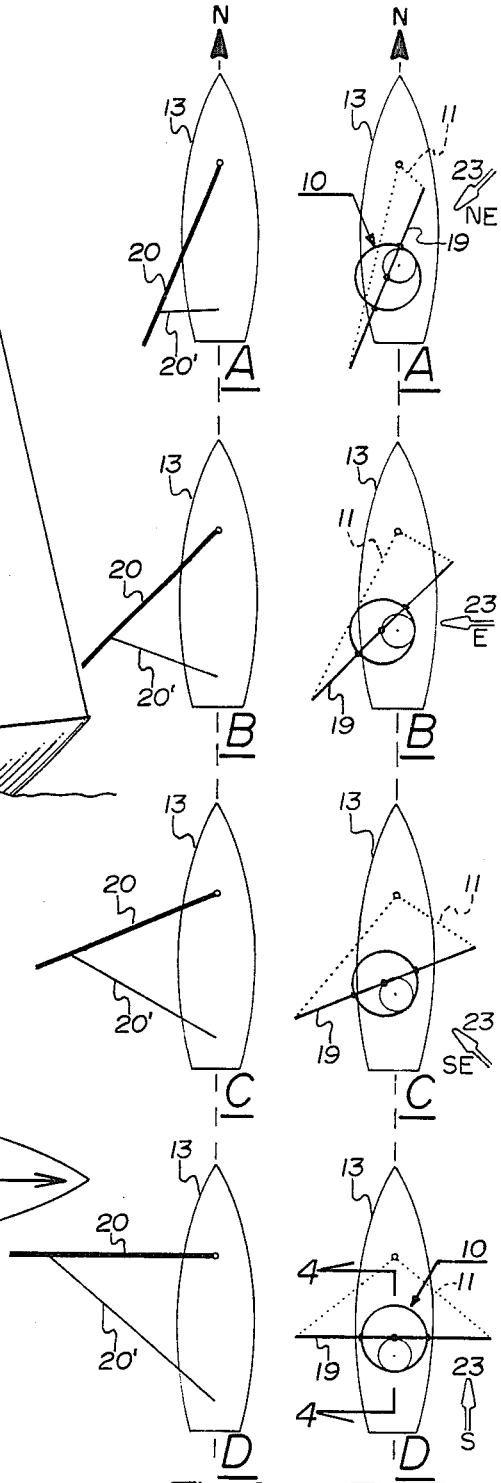
Fig. 2
(PRIOR ART)
Fig. 3

FOIL CONTROL FEEDBACK MECHANISM

This is a continuation of application Ser. No. 718,170 filed Apr. 1, 1985 now abandoned. Which is a continuation of Ser. No. 432,349 filed on July 8, 1983 now abandoned.

BACKGROUND OF THE INVENTION

1. Field of the Invention

This invention relates to the field of sails and sailing vessels.

2. Description of the Prior Art

In sailing it is often desired to "trim" the sails of a sailing vessel, that is, to change the angle of the sail and the boom relative to the center line of the vessel in response to a change in wind direction. The traditional way of trimming sails is to secure one end of the base of the sail to a fixed point relative to the hull of the vessel, and the other to a line, called a "sheet", which is pulled or released by hand or winch and secured for each change of relative wind direction. Various methods of shaping the sail (Kratz, U.S. Pat. No. 3,768,426) or of rotating the boom (Jamieson, U.S. Pat. No. 4,044,702) have been devised, but neither of these methods "trims" the sail.

Ram, U.S. Pat. No. 2,893,339, teaches a method of trimming sails by use of a rigging system and sheet control wheel. However, a disadvantage of the Ram system is its need for crew supervision. Likewise, Rachie, U.S. Pat. No. 3,707,935 discloses a sail positioning mechanism. Rachie's device is applied to a surfing sailboat, and, like Ram, requires manual operation.

As will be seen, the present invention provides a method of trimming sails with some similarity to the prior art, however, with the distinct advantage of functioning automatically.

SUMMARY OF THE INVENTION

An improvement in the method of trimming sails is disclosed. The invention, as in the prior art, includes a sail attached at its topmost end to a mast, and at the bottom to a boom situated so as to rotate in a plane about its center. The boom is mounted on a control device which is in turn attached to the vessel. With the improvement of the present invention, a 2:1 hypocycloidal gearing is achieved between the load (vessel) and the sail. In this manner, the sail maintains the optimum angle to the relative wind, with the additional improvement of reducing the possibility of the sail entering the water.

BRIEF DESCRIPTION OF THE DRAWINGS

FIGS. 1(*a*)–1(*b*) are perspective views illustrating one embodiment of the present invention as applied to a mono-hulled sailboat.

FIGS. 2(*a*)–2(*d*) illustrate sail positioning on a sail boat utilizing prior art methods of trimming.

FIGS. 3(*a*)–3(*d*) illustrates sail positioning on a sail boat utilizing the present invention.

DETAILED DESCRIPTION OF INVENTION

Figure 4:
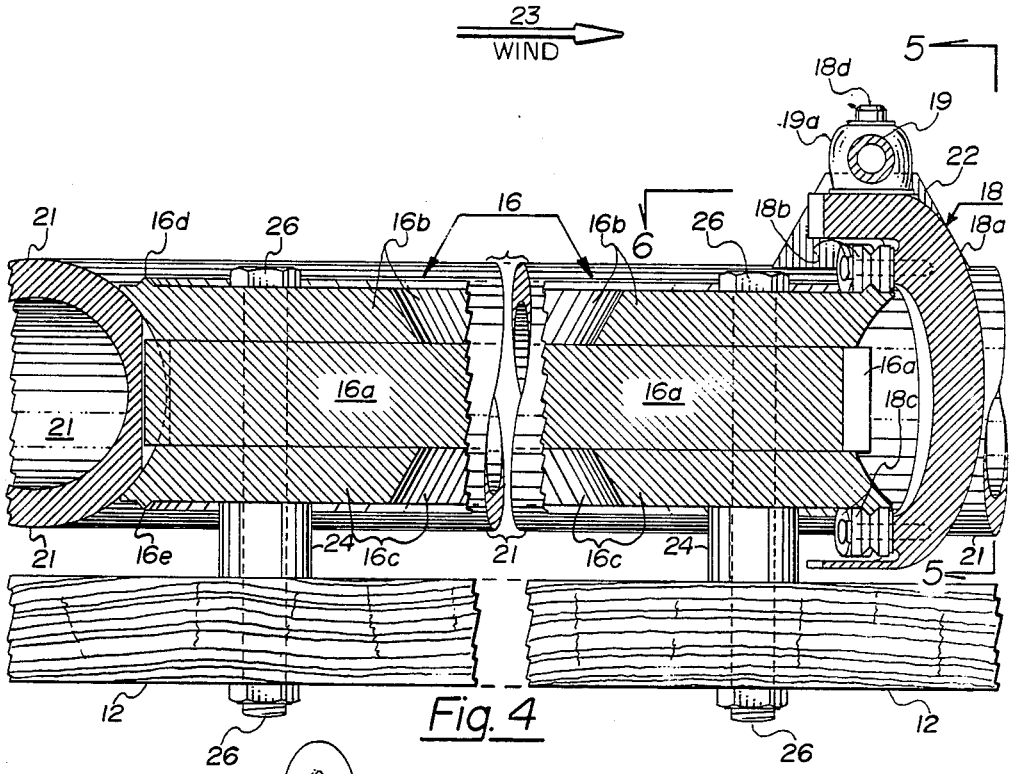
FIG. 4 illustrates a longitudinal section of one embodiment of the invention on the line which bisects the hub, traveller, truck, and boom.

The preferred embodiment of the present invention is shown in FIGS. 1(*a*) and 1(*b*) as applied to a mono-hulled sail boat 13. The invention consists of the hub 16, the traveller 17, truck 18, boom 19, and brackets 22. In the illustrated application of the invention, a symetrical sail 11 is attached to the boom with the perpendicular bisector 11*a* of the sail being normal to the boom 19. The sail 11 is attached to the top of the mast 14 by a swivel joint. The plane of rotation of the boom 19, and therefore the sail, should be at such an angle to the hull of the boat 13, that the net sum of all lift and drag forces on the sail have a sufficiently large forward thrust component to propel the craft foward.

Figure 5:
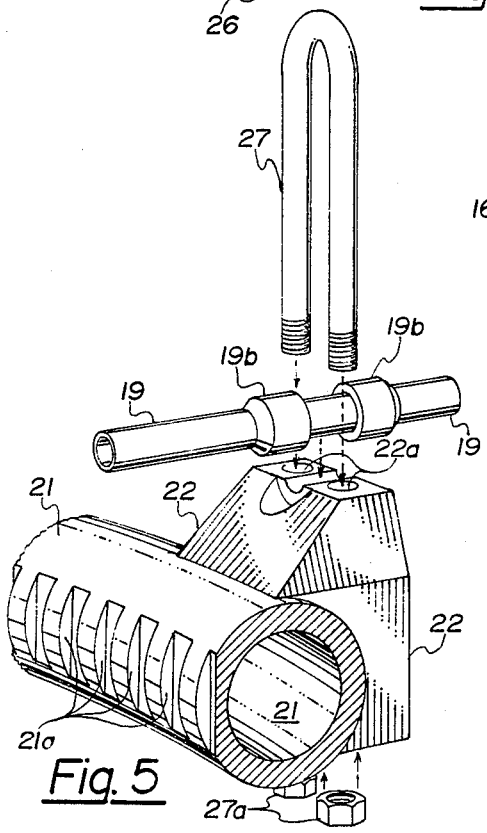
FIG. 5 is a perspective view illustrating the traveller and boom connection.
Figure 6:
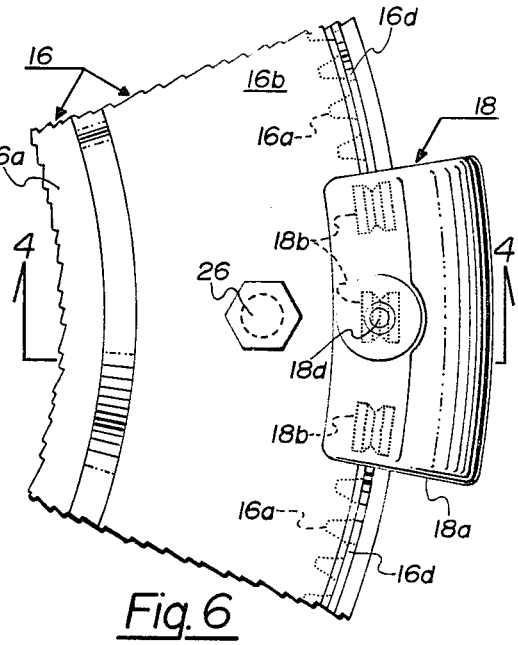
FIG. 6 illustrates a perspective view of the truck and hub positioning.
Figure 7:
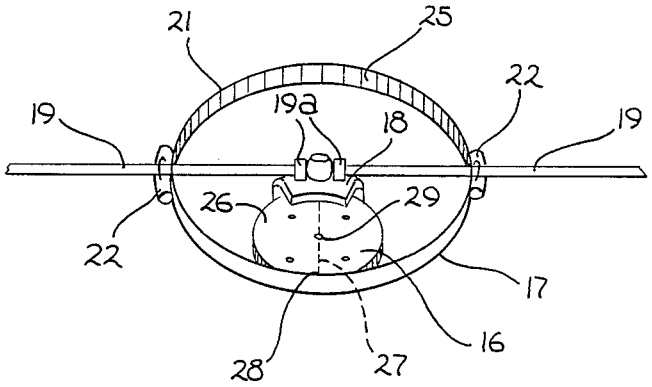
FIG. 7 illustrates a perspective view of the hub, boom and traveller.

The present invention in its preferred embodiment is shown in FIG. 7. As shown in the drawing, the boom 19 bisects the center of the circle formed by the traveller 17. The boom 19 is attached to the traveller by means of brackets 22 which engage the traveller 17 at its outside edge 21. One method of attaching the boom 19 to the traveller 17 is illustrated in FIG. 5. A U-bolt 27 holds the boom 19 in place and longitudinal movement of the boom is prevented by the collars 19*b*. The notches 21(*a*) of traveller 17 such that the bracket 22 is locked into one position in relation to the traveller 17.

Referring back to FIG. 7, the center of the broom 19 is attached by means of a truck 18 to the edge of the hub 16. As shown in FIG. 4 the mast 19 is connected to the truck by means of a swivel joint 18(*d*) with collars 19(*a*) on the boom to prevent longitudinal movement of the boom 19. The truck 18 engages the hub 16 by means of grooved rollers 18(*b*) and (*c*) which ride on ridges 16(*d*) and (*e*) located on the edge of the hub 16.

Referring again to FIG. 7, the hub 16 is attached to the ship by means of bolts 26. The hub 16 is separated from the base 12 by means of the hub collars 24 of FIG. 4. The apparatus is situated such that the inside edge 25 of the traveller 17 engages the hub 16 such as at point 28 of FIG. 7. The apparatus is disposed such that the line 27 between the center of the boom and the hub traveller interface 28 bisects the hub through its center 29. The inside edge 25 of the traveller 17 is lined with teeth which interlock with teeth on the outside edge of the hub 16.

As seen from the drawings, the components of the mechanism collectively comprise a 2:1 hypocycloidal gearing of the hub 16 to the traveller 17 so that every two (2) degrees of revolution of the traveller 17 around the hub 16 produces a one (1) degree rotation of the boom 19 about its own axis, which coincides with swivel bolt 18(*d*). Proper positioning of the device results in the boom 19 being perpendicular to the longitudinal axis of the boat 13 when the hub 16 and the traveller 17 are engaged at their sternmost points as seen in FIG. 3(*d*). The 2:1 gear ratio is achieved by having the inner circumference of the traveller 17 exactly twice the outer circumference of the hub 16.

The result of the invention is a device which maintains the sail continuously and automatically at an angle to the longitudinal axis of the boat exactly one half the angle of the relative wind. Such a relationship betwen sail and wind results in maximum forward thrust.

In operation, the present invention serves to automatically trim the sail. This is best illustrated in FIGS. 3(*a*)–3(*d*). When the ship 13 is acted on by a following wind 23 as in FIG. 3(*d*), the sail 11 and thus the traveller 17 are pushed forward as far as the hub will allow. Since the sail 11 is perpendicular to the force of the wind 23, the maximum amount of momentum is imparted to the craft 13. As the apparent wind 23 shifts forward along the right side of the craft 13 as in FIG. 3(*c*), the traveller 17 tends to revolve away from the wind, with each two (2) degrees of revolution of the traveller 17 inducing one (1) degree rotation of the boom 19. When the wind 23 moves along the edge of the craft, the aerodynamic lift forces of the sail become more pronounced. These forces tend to force the traveller 17 to its most downwind position, which becomes a point of equilibrium, as seen in FIG. 3(*c*), such that the wind blows parallel to the line formed between the truck 18 and the hub traveller interface 28. The same phenomenon is again illustrated in FIG. 3(*b*). The wind is perpendicular to the longitudinal axis of the boat 13 as is the line formed between the truck 18 and the point at which the hub contacts the traveller. However, because of the 2:1 gearing ratio the sail 11 and the boom 19 are the optimum angle for such conditions, namely at 45 degrees to the longitudinal axis.

In a direct headwind, the boom 19 and sail 11 are in a plane parallel to the longitudinal axis of the boat 13. Under these conditions, the sail trimmer functions as a windvane. Since the traveller 17 is in equilibrium in the downwind position, its action prevents the sail 11 from becoming perpendicular to a forewind. The action of the sail trimmer is identical but symmetrical when the wind comes from the left side of the boat 13, constantly and automatically maintaining the optimum angle of the sail to the wind.

The response of a vessel utilizing prior art trimming methods is displayed in FIGS. 2(*a*) through (*d*). Comparing FIG. 2(*d*) to FIG. 3(*d*), to take full advantage of an aft wind, conventional trimming techniques extend the boom 20 to a position perpendicular to the wind. However, now the center of the boom 20 and thus the center of the forward thrust is located outside the boat 13. In additional, the boom 20 and thus the sail is in greater danger of dipping into the water because of the amount of boom extending the outside the boundary of the boat. As seen in FIG. 3(*d*), the center of the force of an aftwind on a boat utilizing the present invention coincides with the longitudinal axis of the boat. The ends of the boom 19 are more nearly inboard than that of the conventional boom 20, thus reducing the chance that the sail and boom will dip into the water.

Alternate embodiments of the present invention of the present invention include a traveller whose outside edge engages a hub such that the gear ratio remains 2:1, as well as non-rigid travellers which use chains, belts, or even hydraulic gearing. Such an automatic trimmer could function from the top or middle portion of a sail as well as the base, if appropriately modified. In addition to sails, the present invention can be used to trim rigid air-foils or chutes or other non-symetrical sails. For specialized applications, an excentrially shaped hub may be employed. Common to all embodiments is a 2:1 gearing ratio and a means for the sail to rotate in reaction to the relative wind without the application of any other external forces.

I claim:

1. A device for controlling the position of a foil attached to a load in relation to a wind force acting on said foil comprising:

a gearing system coupled to said foil;

said gearing system producing one (1) degree of rotation of said foil for each two (2) degrees of rotation of the direction of said acting force relative to said foil through an arc of 360 degrees about said foil;

said acting force acting on said foil being the sole force utilized to position said foil;

whereby said foil maintains an effective orientation to said acting force for imparting momentum to said load.

2. The device as defined by claim 1 wherein said gearing system consists of a hypocycloidal gear assembly.

3. The device as defined by claim 2, wherein said hypocycloidal gearing system comprises:

a traveller coupled to said foil;

a hub coupled to said load;

attaching means for attaching said traveller to said hub.

4. The device as defined by claim 3, wherein said traveller comprises a rigid hoop having an inner and outer face, said inner face contacting said hub.

5. The device as defined by claim 3, wherein said hub comprises a circular-disk having a peripheral edge, said peripheral edge contacting said traveller.

6. A device for controlling the position of a foil attached to a load in relation to a force acting on said foil which comprises:

an attaching means for attaching said foil to a boom;

brackets for attaching said boom at fixed locations to a traveller, said traveller, brackets and boom forming a boom-traveller assembly;

a truck for attaching said boom-traveller assembly to a hub wherein the line between the center of said boom and the point at which said traveller engages said hub extends through the geometric center of said hub; said truck having a means for moving along the edge of said hub;

a gearing ratio between said traveller and said hub wherein one (1) degree of rotation in said foil is produced for each two (2) degrees of rotation of the direction of said force relative to said foil;

whereby said foil maintains the optimum orientation to said force for imparting momentum to said load.

7. The device of claim 6, wherein said hub is stationery with respect to said load.

8. The device of claim 6, wherein said traveller and said hub have a 2:1 hypocycloidal gear ratio.

9. The device of claim 6, wherein said traveller consists of a rigid hoop whose inside face engages the outside edge of said hub.

10. The device of claim 6, wherein said foil is a sail.

11. The device of claim 6, wherein said load is a sail boat.

12. The device of claim 6, wherein said force is a wind.

13. A device for controlling the position of a foil attached to a boat in relation to a force acting on said foil which comprises:

fasteners for attaching said foil to a boom;

a traveller, said traveller forming a solid hoop having an inner and outer face, said traveller including gear teeth on said inner face;

brackets for attaching said boom at two fixed points on said traveller, said boom crossing the geometric center of said traveller, said brackets containing said boom by means of U-shaped restraints, said restraints connected to a rounded base of said bracket engaging said traveller;

a disk shaped hub, said hub including upper, lower and peripheral edges, said hub attached to said load in a fixed position by means of restraining bolts, said hub including gear teeth along said peripheral edge, said hub having a raised track along said upper and lower edge, said hub having a circumference approximately one half the inner circumference of said traveller;

a truck for attaching of said boom and said traveller to said hub, said truck engaging said hub by rollers engaging said upper and lower tracks on said hub, said truck containing said boom by a swivel joint engaging the center of said boom; said inside face of said traveller engaging said geared edge of said hub wherein the line between said swivel joint and the point at which said traveller engages said hub extends through the center of said hub;

a base for mounting said hub; said base attached to said boat an an angle resulting in forward motion when said foil is acted upon by said force;

whereby said foil rotates one degree for each two degree change in the direction of force, maintaining said foil at the optimum orientation to said force for imparting momentum to said boat.

14. A device for controlling the position of a foil attached to a load in relation to a wind force acting on said foil comprising:

means for conveying rotational energy coupled to said foil;

said means for conveying rotational energy producing one (1) degree of rotation of said foil for each two (2) degrees of rotation of the direction of said acting force relative to said foil through an arc of 360 degrees about said foil;

said acting force being the sole force utilized to position said foil;

whereby said foil maintains an effective orientation to said acting force for imparting momentum to said load.

15. The device as defined by claim 14 wherein said means for conveying rotational energy consists of a hypocycloidal gear assembly.

16. The device as defined by claim 15, wherein said hypocycloidal gearing system comprises:

a traveller coupled to said foil;

a hub coupled to said load;

attaching means for attaching said traveller to said hub.

17. The device as defined by claim 16, wherein said traveller comprises a rigid hoop having an inner and outer face, said inner face contacting said hub.

* * * * *